US012446644B2

(12) United States Patent
White

(10) Patent No.: US 12,446,644 B2
(45) Date of Patent: Oct. 21, 2025

(54) HEADWEAR SUPPORT ASSEMBLY AND METHOD

(71) Applicant: Cap Creatures, Inc., San Diego, CA (US)

(72) Inventor: Casey Loring White, San Diego, CA (US)

(73) Assignee: Cap Creatures, Inc., San Diego, CA (US)

( * ) Notice: Subject to any disclaimer, the term of this patent is extended or adjusted under 35 U.S.C. 154(b) by 0 days.

(21) Appl. No.: 18/753,815

(22) Filed: Jun. 25, 2024

(65) Prior Publication Data

US 2025/0057272 A1 Feb. 20, 2025

Related U.S. Application Data

(60) Provisional application No. 63/532,762, filed on Aug. 15, 2023.

(51) Int. Cl.

| | |
|---|---|
| ***A47F 7/06*** | (2006.01) |
| ***A42B 1/002*** | (2021.01) |
| ***A47G 25/10*** | (2006.01) |

(52) U.S. Cl.

CPC ..... *A42B 1/002* (2013.01); *A47F 7/06* (2013.01); *A47G 25/10* (2013.01)

(58) Field of Classification Search

CPC . A47F 5/04; A47F 7/06; A42B 11/002; A42C 3/04; A47B 61/04; A47G 25/10

USPC ..... 211/33, 30; D6/316, 688.17, 709.11

See application file for complete search history.

(56) References Cited

U.S. PATENT DOCUMENTS

| | | | | | |
|---|---|---|---|---|---|
| 1,124,714 | A | * | 1/1915 | Denning | A47F 7/06 211/32 |
| 1,231,635 | A | * | 7/1917 | Nelson | A47F 7/06 223/66 |
| 1,501,258 | A | * | 7/1924 | Wolfe | A47F 5/06 248/185.1 |
| 1,600,132 | A | * | 9/1926 | Pearl | A47F 5/12 248/185.1 |
| 1,698,633 | A | * | 1/1929 | Jimenez | A47G 25/10 33/8 |
| D77,878 | S | * | 3/1929 | Broch | D6/674.1 |
| 1,710,478 | A | * | 4/1929 | Gallatin | A47F 7/06 211/33 |

(Continued)

FOREIGN PATENT DOCUMENTS

CN 308109235 7/2023

OTHER PUBLICATIONS

Official Action mailed Jun. 2, 2025 in U.S. Appl. No. 29/899,932, 6 pages.

(Continued)

*Primary Examiner* — Jennifer E. Novosad

(74) *Attorney, Agent, or Firm* — Procopio, Cory, Hargreaves & Savitch LLP

(57) ABSTRACT

A headwear support assembly that not only supports one's favorite headwear, but also has the appearance of a character wearing the headwear, bringing the headwear to life, includes one or more bases, which may be in the configuration of feet and/or shoes, one or more legs supported by the one or more bases, and a dome supported by the one or more legs. The dome receives one's headwear to support and store the headwear.

9 Claims, 7 Drawing Sheets

(56) References Cited

U.S. PATENT DOCUMENTS 1,804,931 A * 5/1931 Hoban ..... A42C 3/04 211/33
1,822,297 A * 9/1931 Kemery ..... A42C 3/04 223/66
1,969,716 A * 8/1934 Cohen ..... A47F 7/06 33/8
2,094,810 A * 10/1937 Oppenheimer ..... A47F 7/06 33/8
D125,621 S * 3/1941 Hewitt ..... D6/681
D130,053 S * 10/1941 Worth ..... D20/32
2,456,964 A * 12/1948 Ledure ..... A47F 7/06 297/440.13
3,198,408 A * 8/1965 Benner ..... A47F 7/065 446/268
3,501,072 A * 3/1970 Kovener ..... A47F 5/04 223/66
3,515,318 A * 6/1970 Preble ..... A45D 44/14 223/66
3,603,489 A * 9/1971 Fleisher ..... A45D 44/14 223/66
3,741,448 A * 6/1973 Friedman ..... A45D 44/14 223/66
5,503,312 A * 4/1996 Kassner ..... A47F 7/065 211/33
D390,039 S 2/1998 Rheinish
D390,046 S * 2/1998 Rheinish ..... D6/682
D473,729 S 4/2003 Whitcomb
D473,730 S 4/2003 Whitcomb
7,168,577 B1 * 1/2007 Moseley ..... A47F 7/06 211/32
D600,925 S 9/2009 Guffey
9,538,831 B1 * 1/2017 Tracy ..... D06F 57/04
D788,080 S 5/2017 Turksu
D827,617 S 9/2018 Dillon
D911,620 S * 2/2021 Riddick ..... D28/93
D981,150 S * 3/2023 Zabel ..... D6/677.5
D984,056 S 4/2023 Carter-Robinson
11,653,775 B1 * 5/2023 Rutta ..... A45D 44/14 248/176.1
11,950,714 B2 * 4/2024 Johnson ..... A47K 3/281
D1,067,524 S * 3/2025 Wang ..... D28/93
2013/0292523 A1 * 11/2013 Moore ..... F16M 13/02 248/231.9
2021/0112948 A1 * 4/2021 Wachtfogel ..... A45D 44/14
2025/0057272 A1 * 2/2025 White ..... A42B 1/002

OTHER PUBLICATIONS

Hat Stand Wood Stand, [online]; [review published to the internet on Mar. 15, 2023]; [retrieved from the internet on May 28, 2025]; URL: https://www.etsy.com/listing/1421065333/hat-stand-wood-stand-for-hatmaker-hat. (9 pages). (Year: 2023).

* cited by examiner

HEADWEAR SUPPORT ASSEMBLY AND METHOD

CROSS-REFERENCE TO RELATED APPLICATION

This application claims the benefit of U.S. Provisional Patent Application No. 63/532,762, filed Aug. 15, 2023, under 35 U.S.C. 119 and is incorporated herein its entirety.

FIELD OF THE INVENTION

The present invention relates to headwear support structures.

BACKGROUND

The wearing of headwear such as baseball caps is becoming more popular. Consumers often collect a variety of different types of baseball caps and/or other headwear. A problem with headwear is that, unlike clothes that are hung by hangers in a closet, with headwear there is not a typical convenient way to support or hang it.

SUMMARY

An aspect of the disclosure involves a headwear support assembly that not only supports one's favorite headwear, but also has the appearance of a character wearing the headwear, bringing the headwear to life. The headwear support assembly includes one or more bases, which may be in the configuration of feet and/or shoes, one or more legs supported by the one or more bases, and a dome supported by the one or more legs. The dome receives one's headwear to support and store the headwear. The dome is angled at an angle relative to horizontal at a minimum of 10 degrees. In an embodiment of the headwear support assembly, the dome is angled at an angle relative to horizontal at a maximum of 20 degrees. In a more preferred embodiment of the headwear support assembly, the dome is angled at an angle relative to horizontal at a maximum of 15 degrees. A crown of the dome may include a magnet that magnetically attracts the metal in a baseball cap or other headwear to keep the baseball cap (or other headwear) properly oriented and positioned on the crown.

Another aspect of the disclosure involves a headwear support assembly comprising one or more bases; one or more legs supported by the one or more bases; a dome supported by the one or more legs and configured to support headwear thereon, wherein when the headwear is supported on the dome, the headwear, the dome, the one or more legs, and the one or more bases have the appearance of a character wearing the headwear.

One or more implementations of the immediately above aspect of the disclosure includes one or more of the following: the one or more bases include a pair of bases in the configuration of feet and/or shoes; the dome includes a flat lower surface; the dome, including the flat lower surface, is angled relative to horizontal; the dome, including the flat lower surface, is at a minimum angle of 10 degrees relative to horizontal; the dome, including the flat lower surface, is at a maximum angle of 20 degrees relative to horizontal; the dome, including the flat lower surface, is at a maximum angle of 15 degrees relative to horizontal; the dome includes a crown with a magnet configured to attract metal in headwear to keep the headwear centered on the crown; the one or more bases include a pair of bases in the configuration of feet and/or shoes, and the one or more bases, the one or more legs supported by the one or more bases, and the dome have a configuration of a baseball player; the one or more bases include a pair of bases in the configuration of feet and/or shoes, and the one or more bases, the one or more legs supported by the one or more bases, and the dome have a configuration of one of a football player, a hockey player, a basketball player, and a soccer player; the one or more bases include a pair of bases in the configuration of feet and/or shoes, and/or the one or more bases, the one or more legs supported by the one or more bases, and the dome have a configuration of one of an animated character and a musical performer.

A further aspect of the disclosure involves a method of using a headwear support assembly, the headwear support assembly comprising a pair of base in the configuration of feet and/or shoes, a pair of legs supported by the pair of bases; a dome supported by the pair of legs and configured to support headwear thereon, wherein when the headwear is supported on the dome, the headwear, dome, one or more legs, and one or more bases have the appearance of a character wearing the headwear, the method comprising receiving the headwear on the dome so that the pair of bases in the configuration of feet and/or shoes, the pair of legs, and the headwear on the dome give the appearance of a character wearing the headwear.

One or more implementations of the immediately above aspect of the disclosure includes one or more of the following: the dome is angled at a minimum angle of 10 degrees relative to horizontal; the dome is angled at a maximum angle of 20 degrees relative to horizontal; the dome is angled at a maximum angle of 15 degrees relative to horizontal; the dome includes a crown with a magnet configured to attract metal in headwear to keep the headwear centered on the crown, and the method further comprising attracting metal in the headwear with the magnet in the dome to keep the headwear centered on the crown; and/or the dome is angled relative to horizontal.

BRIEF DESCRIPTION OF DRAWINGS

The accompanying drawings, which are incorporated in and form a part of this specification illustrate embodiments of the invention and together with the description, serve to explain the principles of the invention.

DESCRIPTION OF EMBODIMENT OF THE INVENTION

Figure 1:
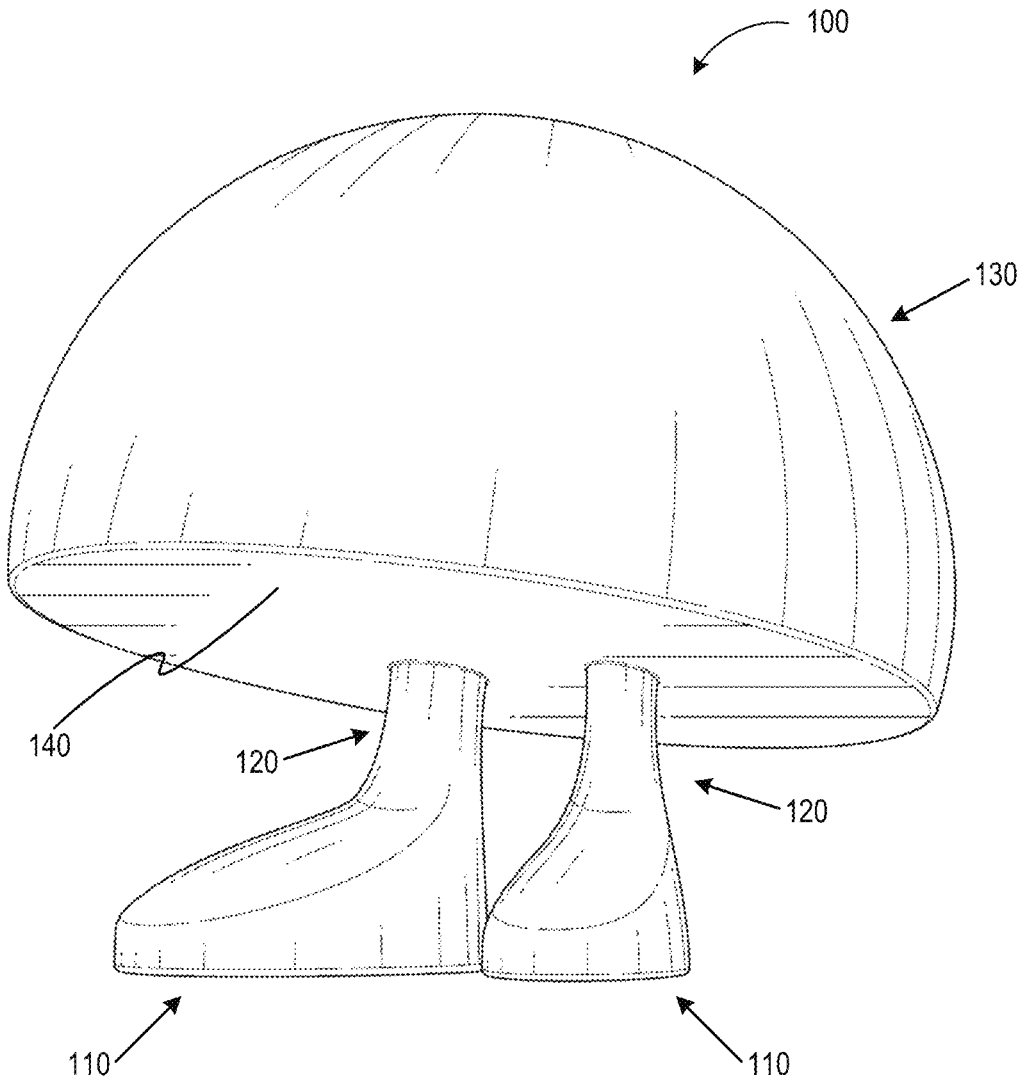
FIG. 1 is a front perspective view of an embodiment of a headwear support assembly.
Figure 2:
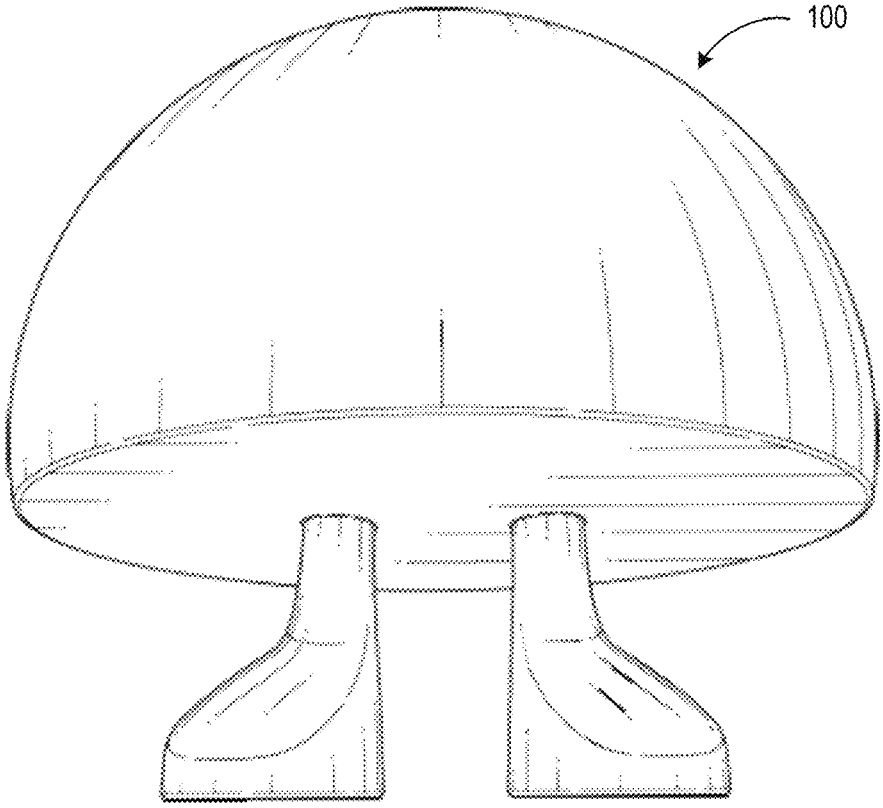
FIG. 2 is a front elevational view of the headwear support assembly of FIG. 1.
Figure 3:
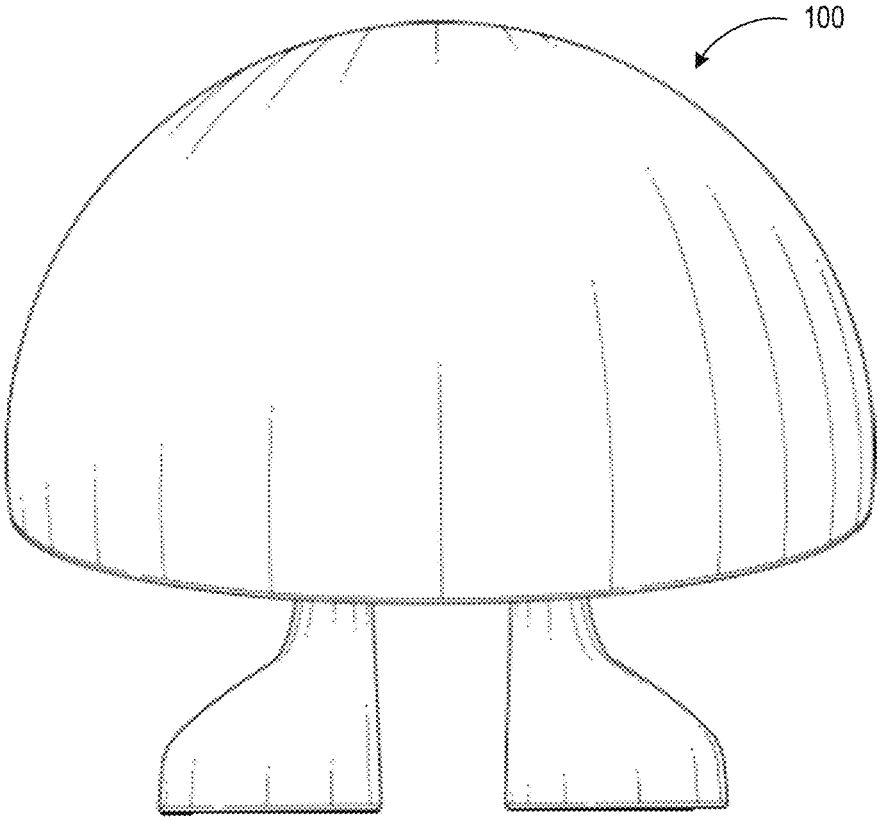
FIG. 3 is a rear elevational view of the headwear support assembly of FIG. 1.
Figure 4:
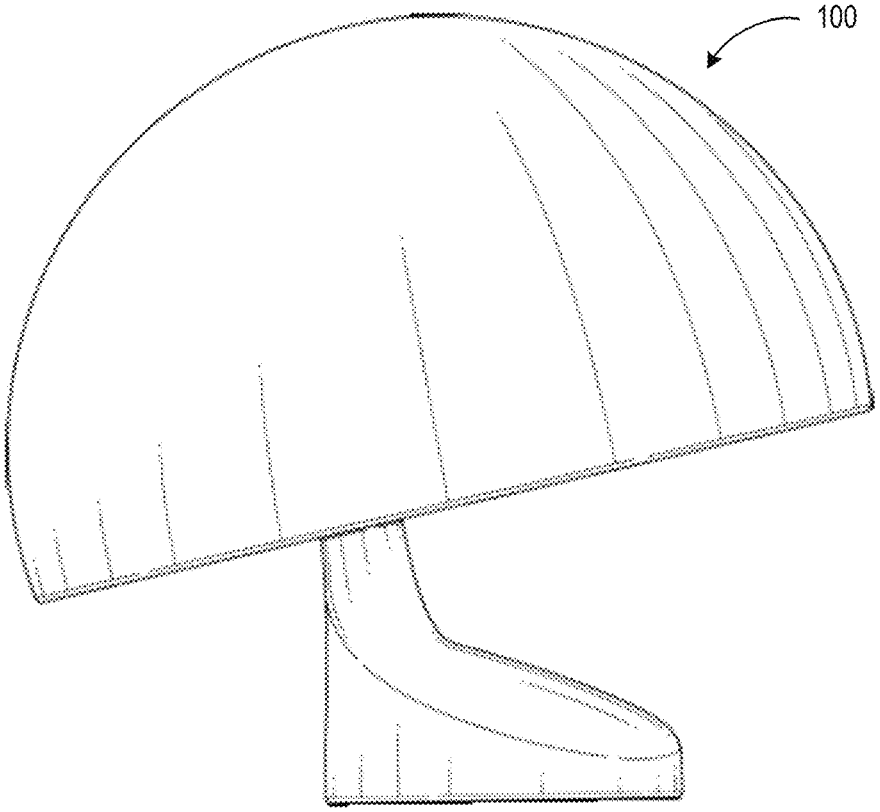
FIG. 4 is a left side elevational view of the headwear support assembly of FIG. 1.
Figure 5:
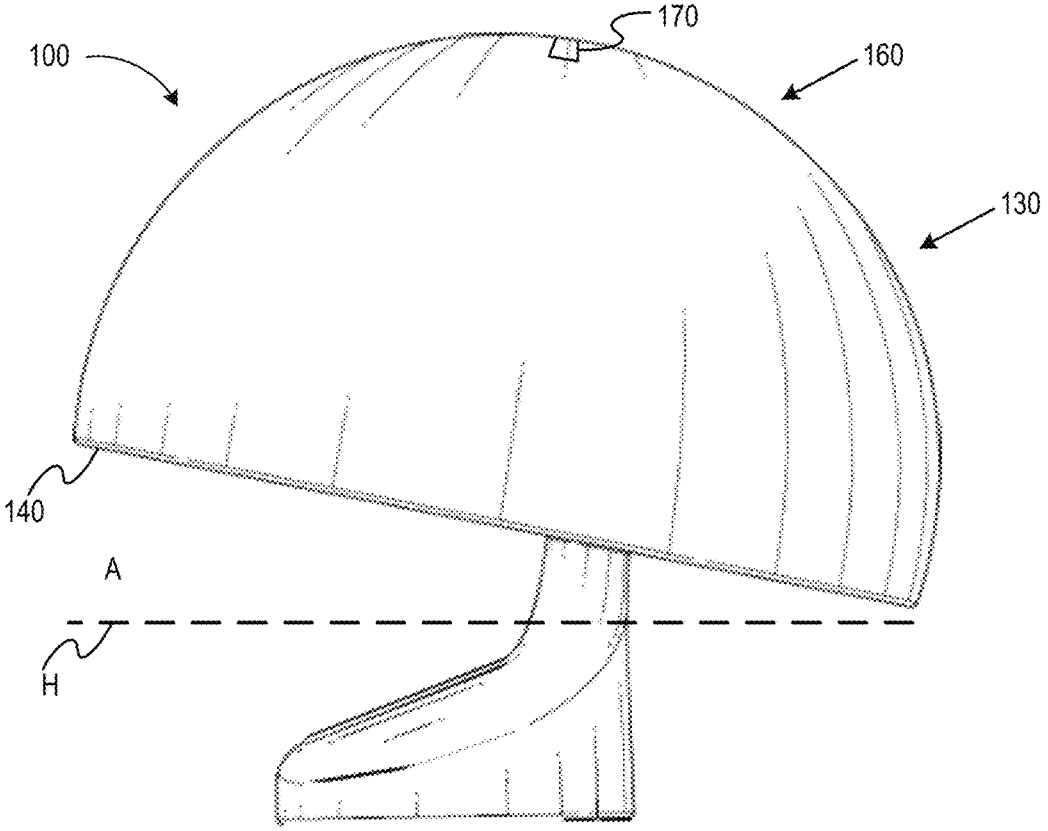
FIG. 5 is a right side elevational view of the headwear support assembly of FIG. 1.
Figure 6:
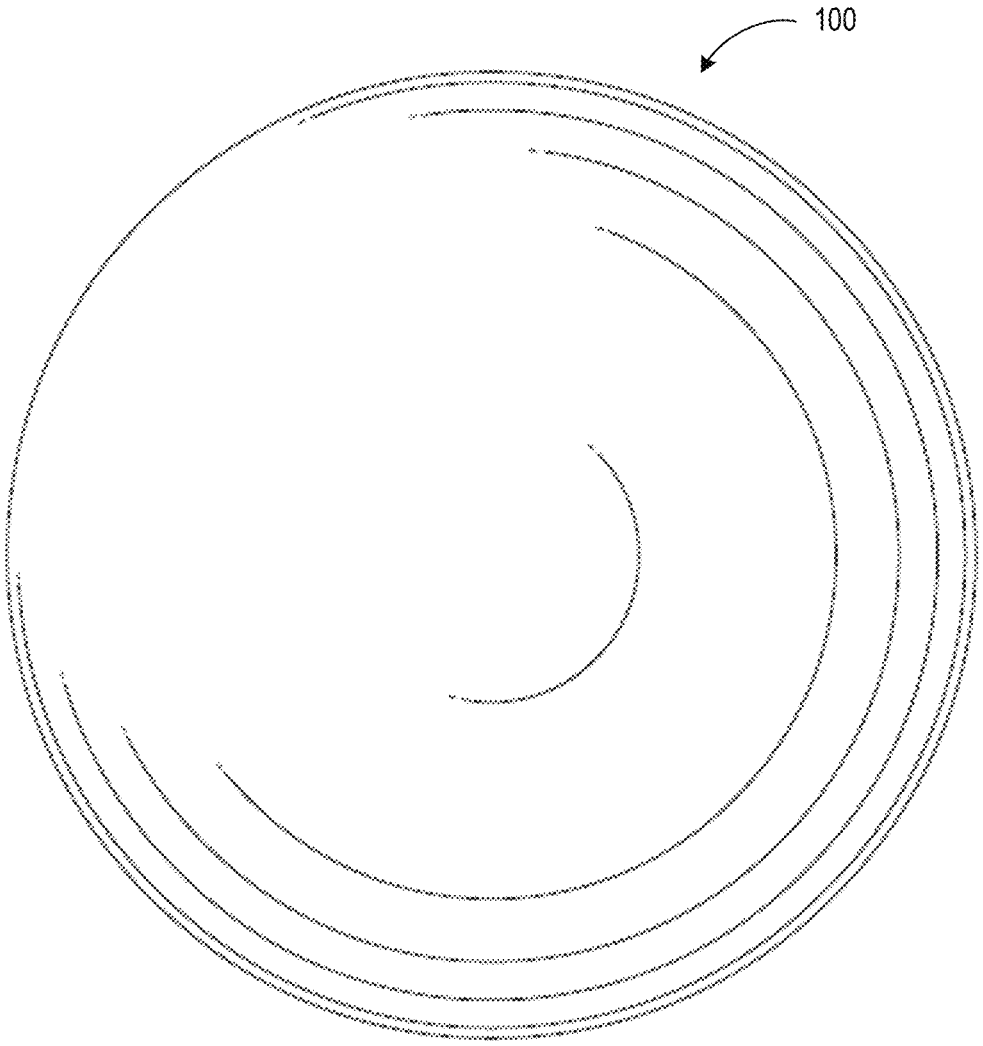
FIG. 6 is a top plan view of the headwear support assembly of FIG. 1.
Figure 7:
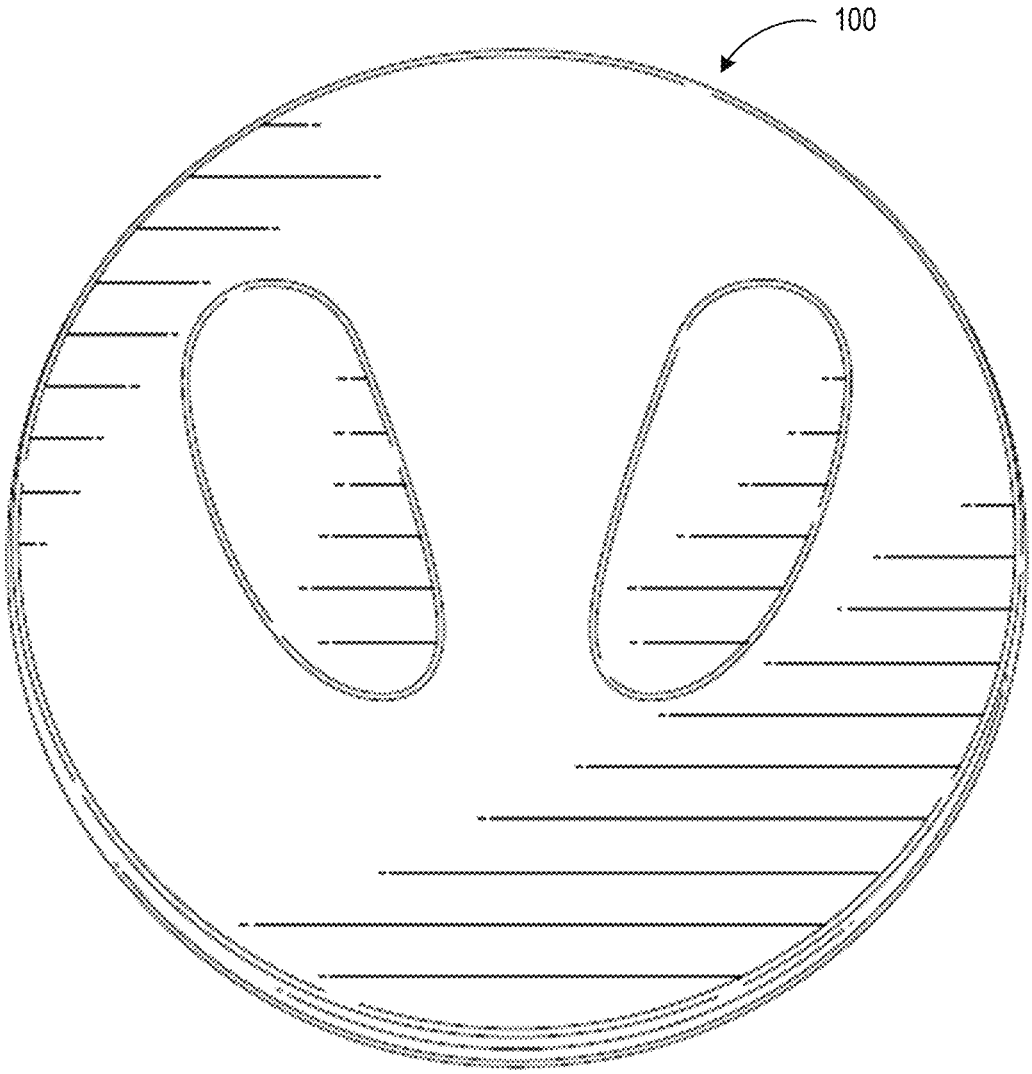
FIG. 7 is a bottom plan view of the headwear support assembly of FIG. 1.
Figure 8:
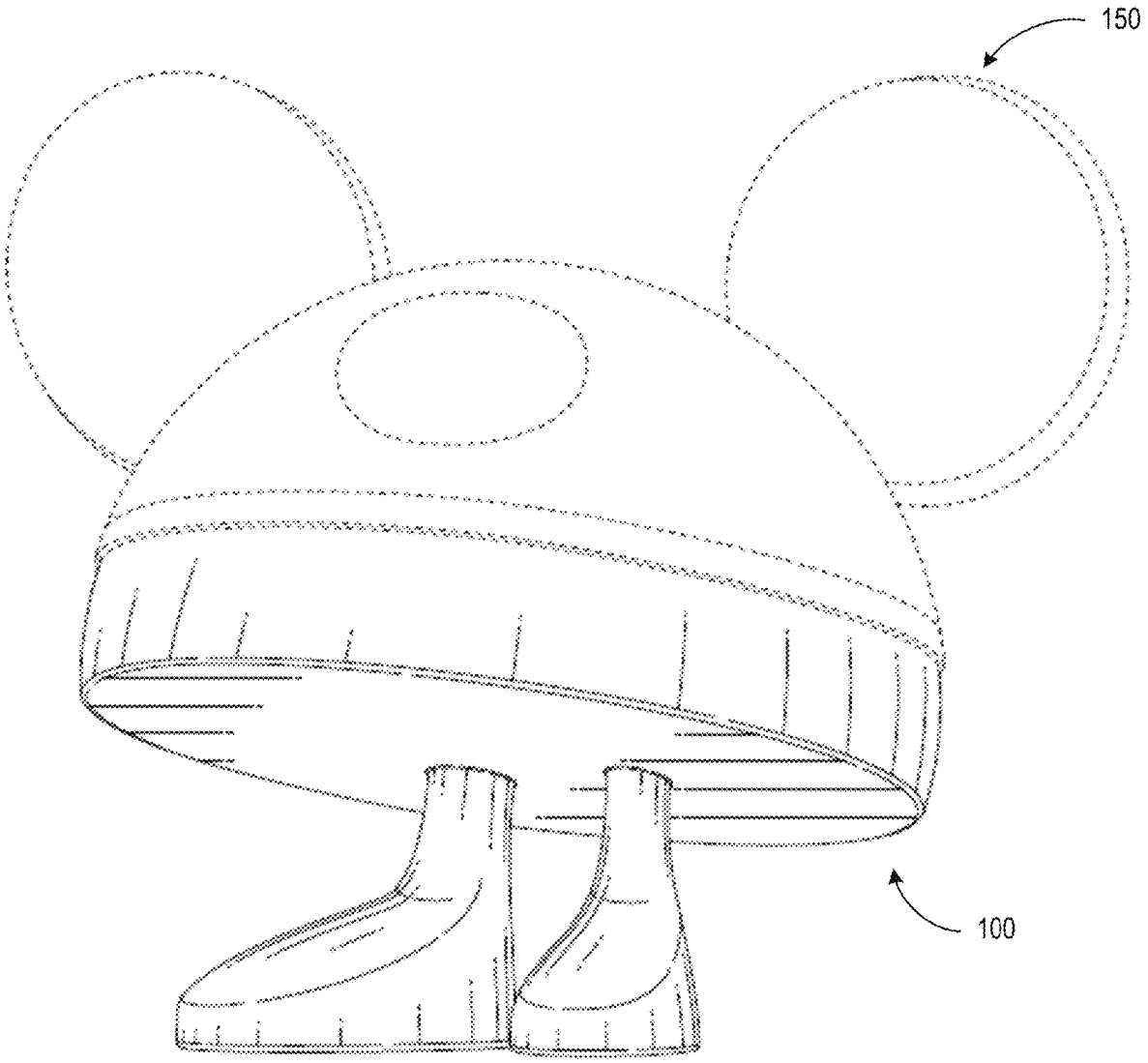
FIG. 8 is a front perspective view of the headwear support assembly of FIG. 1 shown with an example of possible headwear supported by the headwear support assembly.
Figure 9:
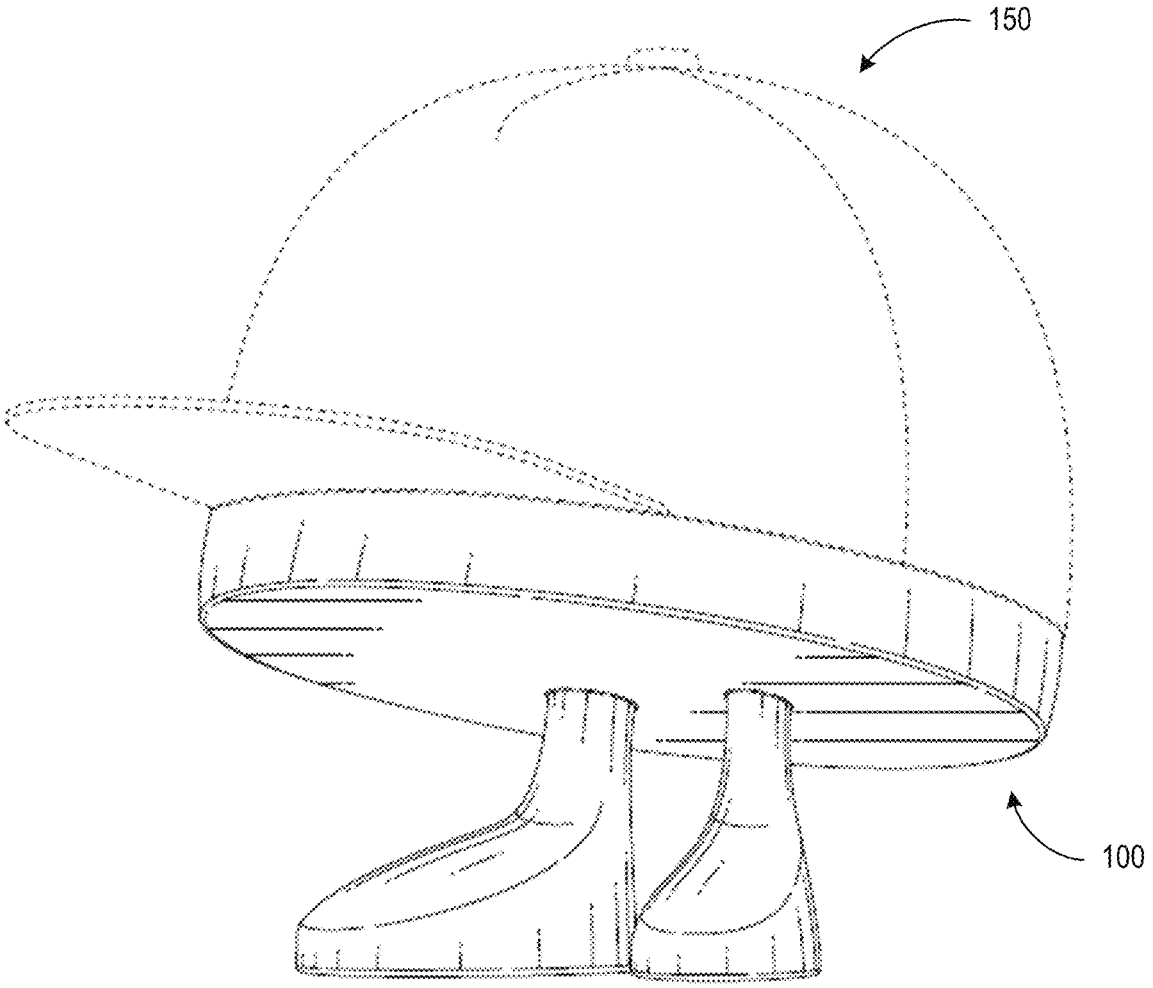
FIG. 9 is a front perspective view of the headwear support assembly of FIG. 1 shown with another example of possible headwear supported by the headwear support assembly.

With reference to FIGS. 1-9, an embodiment of a headwear support assembly 100 that not only supports one's favorite headwear, but also has the appearance of a character wearing the headwear, bringing the headwear to life, will be described. The headwear support assembly 100 includes one or more bases 110, which may be in the configuration of feet and/or shoes, one or more legs 120 supported by the one or more bases 110, and a dome 130 with a substantially flat lower surface 140 supported by the one or more legs 120. The dome 130 receives one's headwear 150 to support and store the headwear 150. The dome 130 and the flat lower surface 140 of the dome 130 are angled at an angle A relative to horizontal H at a minimum of 10 degrees. In an embodiment of the headwear support assembly 100, the dome 130 is angled at an angle A relative to horizontal H at a maximum of 20 degrees. In a more preferred embodiment of the headwear support assembly 100, the dome 130 is angled at an angle A relative to horizontal H at a maximum of 15 degrees. A crown 160 of the dome 130 may include a magnet 170 that magnetically attracts the metal in a baseball cap or other headwear to keep the baseball cap (or other headwear) properly oriented and positioned on the crown 160. FIG. 8 illustrates a first example of possible headwear 150 supported by the headwear support assembly 100 and FIG. 9 illustrates a second example of possible headwear 150 supported by the headwear support assembly 150.

In one or more embodiments, the headwear support assembly 150 may come in one or more colors and/or one or more color combinations, the headwear support assembly 150 may come in one or more configurations (e.g., a Mickey Mouse configuration, a baseball player configuration, a football player configuration, a hockey player configuration, a basketball player configuration, a soccer player configuration, a musical performer configuration, etc.), and/or may come in one or more licensed versions (e.g., MLB, NFL, NHL, NBA, MLS, NCAA, Disney, etc.).

In use, a user dons one's headwear 150 on the dome 130 when not in use and to store/display the headwear 150. The pair of bases 110 in the configuration of feet and/or shoes, the legs 120, and the headwear 150 oriented on the dome 130 at the angle A gives the appearance of a character wearing the headwear 150, bringing the headwear 150 to life.

The figures may depict exemplary configurations for the invention, which is done to aid in understanding the features and functionality that can be included in the invention. The invention is not restricted to the illustrated architectures or configurations, but can be implemented using a variety of alternative architectures and configurations. Additionally, although the invention is described above in terms of various exemplary embodiments and implementations, it should be understood that the various features and functionality described in one or more of the individual embodiments with which they are described, but instead can be applied, alone or in some combination, to one or more of the other embodiments of the invention, whether or not such embodiments are described and whether or not such features are presented as being a part of a described embodiment. Thus the breadth and scope of the present invention, especially in the following claims, should not be limited by any of the above-described exemplary embodiments.

Terms and phrases used in this document, and variations thereof, unless otherwise expressly stated, should be construed as open ended as opposed to limiting. As examples of the foregoing: the term "including" should be read as mean "including, without limitation" or the like; the term "example" is used to provide exemplary instances of the item in discussion, not an exhaustive or limiting list thereof; and adjectives such as "conventional," "traditional," "standard," "known" and terms of similar meaning should not be construed as limiting the item described to a given time period or to an item available as of a given time, but instead should be read to encompass conventional, traditional, normal, or standard technologies that may be available or known now or at any time in the future. Likewise, a group of items linked with the conjunction "and" should not be read as requiring that each and every one of those items be present in the grouping, but rather should be read as "and/or" unless expressly stated otherwise. Similarly, a group of items linked with the conjunction "or" should not be read as requiring mutual exclusivity among that group, but rather should also be read as "and/or" unless expressly stated otherwise. Furthermore, although item, elements or components of the disclosure may be described or claimed in the singular, the plural is contemplated to be within the scope thereof unless limitation to the singular is explicitly stated. The presence of broadening words and phrases such as "one or more," "at least," "but not limited to" or other like phrases in some instances shall not be read to mean that the narrower case is intended or required in instances where such broadening phrases may be absent.

The invention claimed is:

1. A headwear support assembly, comprising:

one or more bases;

one or more legs supported by the one or more bases;

a dome supported by the one or more legs and configured to support headwear thereon, wherein when the headwear is supported on the dome, contours of both the headwear and the dome mate, the dome includes a substantially flat lower planar surface that the one or more legs extend from, and the headwear, the dome, the one or more legs, and the one or more bases have the appearance of a character wearing the headwear, wherein the one or more bases include a pair of bases in the configuration of feet and/or shoes, and the one or legs include a pair of legs in the configuration of the legs of the character.

2. The headwear support assembly of claim 1, wherein the one or more bases, the one or more legs supported by the one or more bases, and the dome have a configuration of a baseball player.

3. The headwear support assembly of claim 1, wherein the one or more bases, the one or more legs supported by the one or more bases, and the dome have a configuration of one of an animated character and a musical performer.

4. A method of using the headwear support assembly of claim 1, the method comprising receiving the headwear on the dome so that the pair of bases in the configuration of feet and/or shoes, the pair of legs, and the headwear on the dome give the appearance of a character wearing the headwear.

5. The method of claim 4, wherein the dome is angled at a minimum angle of 10 degrees relative to horizontal.

6. The method of claim 5, wherein the dome is angled at a maximum angle of 20 degrees relative to horizontal.

7. The method of claim 5, wherein the dome is angled at a maximum angle of 15 degrees relative to horizontal.

8. The method of claim 5, wherein the dome includes a crown with a magnet configured to attract metal in headwear to keep the headwear centered on the crown, and the method further comprising attracting metal in the headwear with the magnet in the dome to keep the headwear centered on the crown.

9. The method of claim 8, wherein the dome is angled relative to horizontal.

* * * * *